US006629692B2

(12) United States Patent
Allner et al.

(10) Patent No.: US 6,629,692 B2
(45) Date of Patent: Oct. 7, 2003

(54) DEVICE FOR SEPARATING AN UPPERMOST SHEET FROM A SUPPLY STACK BY MEANS OF AIR BLOWERS

(75) Inventors: Ralf Allner, Esslingen (DE); Thomas Biber, Aalen (DE)

(73) Assignee: NexPress Solutions LLC, Rochester, NY (US)

( * ) Notice: Subject to any disclaimer, the term of this patent is extended or adjusted under 35 U.S.C. 154(b) by 12 days.

(21) Appl. No.: 10/020,602

(22) Filed: Dec. 6, 2001

(65) Prior Publication Data

US 2002/0047235 A1 Apr. 25, 2002

Related U.S. Application Data

(60) Provisional application No. 60/271,328, filed on Feb. 23, 2001.

(30) Foreign Application Priority Data

Feb. 25, 2000 (DE) ..... 100 08 909

(51) Int. Cl.[7] ..... B65H 3/14

(52) U.S. Cl. ..... 271/98; 271/90; 271/104; 271/106; 271/97

(58) Field of Search ..... 271/5, 90, 94, 271/104, 106, 97, 98

(56) References Cited

U.S. PATENT DOCUMENTS 4,184,672 A 1/1980 Watkins et al. ..... 271/105
4,699,369 A 10/1987 Zirilli ..... 271/94
5,092,578 A * 3/1992 Bergmeier et al. ..... 271/97
5,110,110 A * 5/1992 Wirz et al. ..... 271/98
5,645,274 A * 7/1997 Ubayashi et al. ..... 271/94
5,709,379 A * 1/1998 Lotsch et al. ..... 271/105

FOREIGN PATENT DOCUMENTS

EP 0 453 835 A2 10/1991
EP 0 612 680 A1 8/1994

* cited by examiner

*Primary Examiner*—Donald P. Walsh
*Assistant Examiner*—Kaitlin Joerger
(74) *Attorney, Agent, or Firm*—Lawrence P. Kessler

(57) ABSTRACT

A device (I) for separating an uppermost sheet (S1) from a supply stack (S), for the purpose of grasping the separated uppermost sheet and feeding it, wherein air blowers (3.1) for spreading apart several sheets of an upper sheet stack area (SR) and air blowers (3.2) for separating the uppermost sheet (S1) and holding back an adhering sheet (S2), are located downstream in front of the supply stack and transverse to a sheet transport path (42), and wherein air jets with different pressures, directions, and diameters may be generated by the air blowers (3.1; 3.2) supplied from an air pressure source (6) with at least one air nozzle (31) located in the area of a center line (Y, Z) of the stack (2) and the transport path (42) and with several air nozzles (32) located on both sides of the center line.

8 Claims, 5 Drawing Sheets

DEVICE FOR SEPARATING AN UPPERMOST SHEET FROM A SUPPLY STACK BY MEANS OF AIR BLOWERS

This is a provisional of application No. 60/271,328 filed on Feb. 23, 2001.

FIELD OF THE INVENTION

The invention concerns a device for separating an uppermost sheet from a supply stack with air blowers in the area of a sheet transport unit having a sheet bending mechanism operating with a partial vacuum and feeding to a processing station in a sheet processing device.

BACKGROUND OF THE INVENTION

In the case of known sheet processing devices, such as, for example, copiers, the first and second air blowers of the sheet separating device are located downstream in front of the supply stack transverse to a transport path and act opposite the sheet transport device, rising at an angle to the horizontal plane of the sheets, to the upper area of the sheet stack, which may be positioned to the same predetermined equal height by a controlled lifting device. In this case air jets are generated with low excess air pressure as well as with different directions and diameters, on the one hand for spreading by raising several sheets of the upper sheet stack area, and on the other hand for separating by raising the uppermost sheet from the stack as well as by holding back an adhering sheet following the uppermost sheet, by the first air blower supplied from a compressed air source, with an air nozzle located in the area of a center line of the stack and the transport path with several air nozzles located on both sides of the center line and the first air blower.

A device for separating by raising an uppermost sheet from a supply stack in a copier is known from EP-B1-0 812 680, in the case of which on the one hand there is a first air blower mounted centrally with respect to the sheet stack and to the sheet transport path, with an individual air nozzle having a relatively large trapezoidal opening (7.62×6.35 mm to 15.24×19.90 mm) and on the other hand there is a second air blower offset in the direction of sheet transport, in each case with three air nozzles, in each case with relatively large semicircular openings (7.87 to 24.85 $m^2$), mounted on both sides of the center line of the transport path. The alignment of the air jets with the horizontal plane of the sheets in the direction toward the upper area of the sheet stack is in an angular range between 35 to 35 degrees for the air jet of the first air blower and for the air jets of the second air blower. The excess air pressure of the air jets is around 30 mbar and is created on the air nozzles of the air blower by one or two controllable air pressure sources and maintained constant during an operating cycle.

In this case it is disadvantageous that, as a result of the large air nozzle openings and the low excess pressure of the air jets, an uppermost sheet can be separated, and transported away, from the stack only with difficulty or even not individually, in the case of using a sheet of a type of paper which is heavy, thick, or the sheets of which adhere strongly to one another. Thus the range of types of sheets of paper for reliable operation, that is, reliable separation and avoidance of double-sheet transport, is greatly limited.

SUMMARY OF THE INVENTION

Therefore the object of the invention is to create a device, which does not have these named disadvantages, but by which sheets of very different types can be reliably fed from the sheet supply stack to a sheet processing device one after the other reliably and efficiently.

The object is achieved according to the invention with a device in that an additional air blower having several nozzles, supplied by a high pressure air source, is located in the area of the center line of the stack and the transport path, by which air jets with a high excess air pressure and small diameter can be created, which on the one hand support the separation of the uppermost sheet from the stack as well as holding back the adhering sheet following the uppermost sheet, and on the other hand serve for supporting the spreading of the sheets in the upper area of the sheet stack.

Advantageously, air jets with an excess air pressure equal to or greater than 1.0 bar can be created by means of the high pressure air source and the air nozzles of the additional air blower; the pressure ratio of the air jets of the additional air blower to those of the spreading and separating means is equal to or greater than 20:1; and the ratio of the air nozzle opening diameters of the additional air blower to those of the spreading and separating air blowers is equal to or greater than 1:30. The air pressure of the air jets of the additional air blower in this case is essentially constant during an operating cycle, and the air jets of the additional air blower act on the sheets of the upper sheet stack area simultaneously with the air jets of the spreading air blower and separating means having a constant air pressure.

Furthermore, the additional blower advantageously has two nozzle elements with several air nozzles and the nozzle elements are positioned on both sides of the air blower for spreading, a first air blower, and outside the inner air nozzles of the air blower for separation and holding back, a second air blower. The additional, third air blower here in each case has two air nozzles in a vertically overlapping arrangement on the two nozzle elements, the upper air nozzles being directed toward a middle front edge area of the second and third sheets of the stack for the purpose of separating and holding back the adhering second sheet following the first stack sheet, and the lower air nozzles for supporting the spreading and lifting of the sheets located below are directed toward the middle front edge area thereof.

In addition, the air nozzles of the additional air blower, and thus their air jets, are directed advantageously parallel to the horizontal plain of the sheets of the stack and parallel to the central axis of the stack and the sheet transport path. Further features and advantages are to be deduced from the description of the embodiments of the invention shown in the drawing as well as the further subclaims.

BRIEF DESCRIPTION OF THE DRAWINGS

In the detailed description of the preferred embodiment of the invention presented below, reference is made to the accompanying drawings, in which.

DETAILED DESCRIPTION OF THE PREFERRED EMBODIMENTS

The following description according to FIGS. 1 to 5B refers to a preferred embodiment of the device according to the invention for separating a topmost sheet from a supply stack with several air blowers. In this case the device is used in a sheet processing device of known type, such as, for example, a copier. For an expert working in this field it is self-evident here that the device according to the invention also may be used in sheet processing devices such as presses, printers, or sheet sorting devices.

Figure 1:
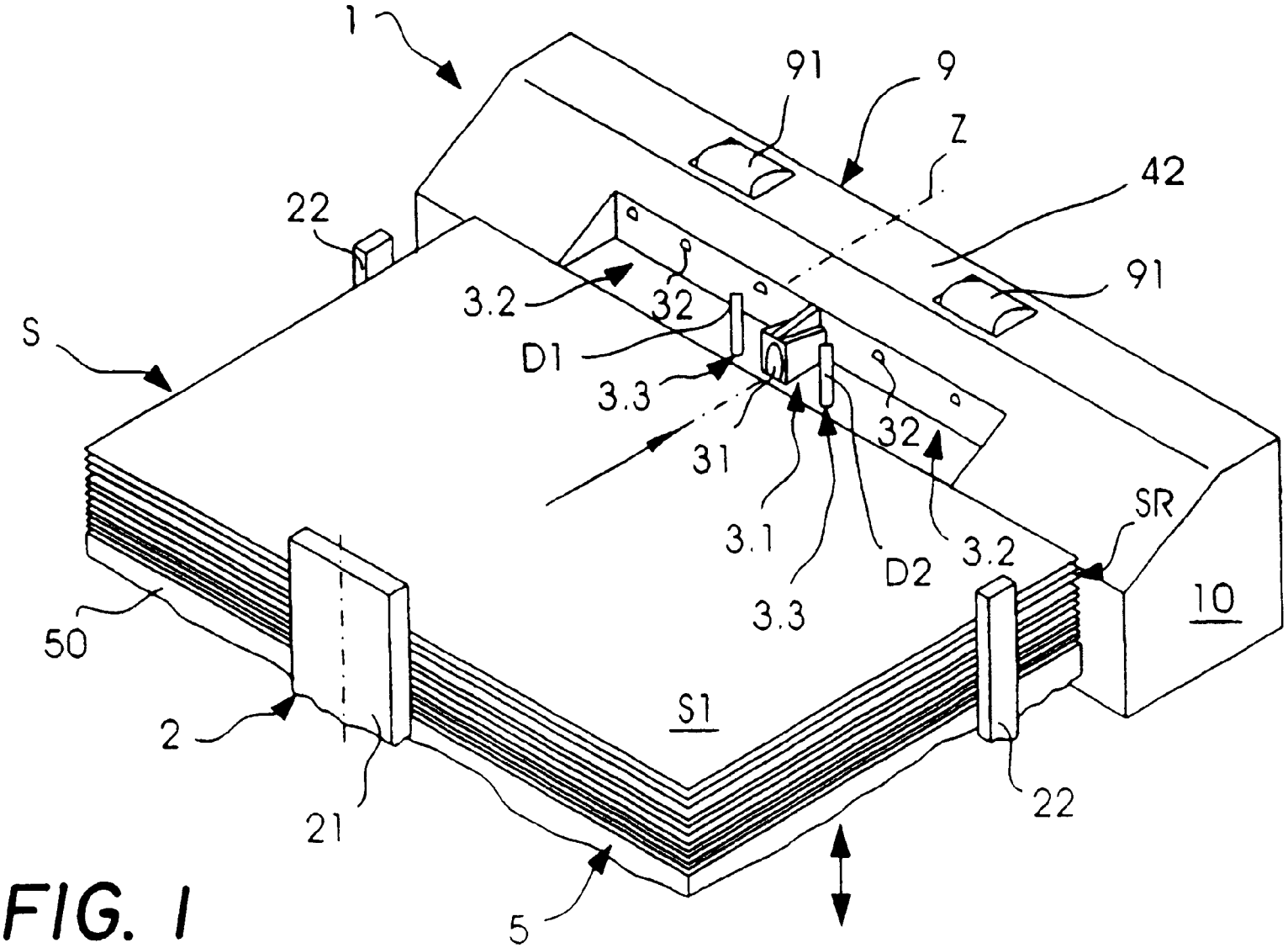
FIG. 1 shows the device according to the invention, with air blowers in the area of a sheet supply stack and sheet entrance area of a sheet processing device, without a sheet transport unit and without a housing in a three-dimensional representation from above.

FIG. 1 shows the separating device 1 according to the invention in the area of a sheet supply stack S held by a magazine 2 and in the sheet intake area 9 of the copier, not shown otherwise. A sheet transport unit 4 in FIGS. 2 and 3 located above the sheet supply stack usually used is omitted in order to show the device according to the invention completely.

Figure 3:
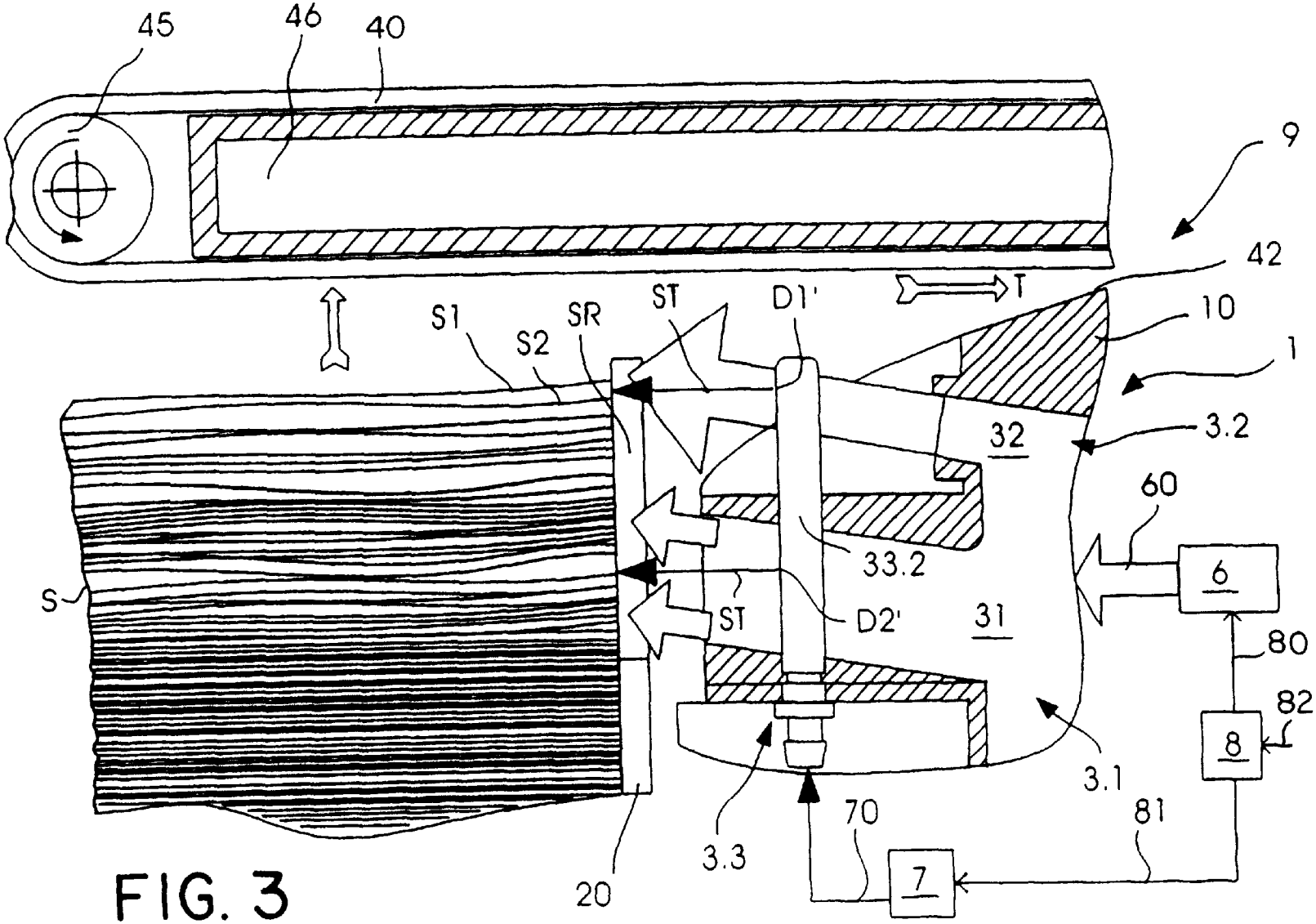
FIG. 3 shows the device according to FIG. 2 in a side view in the section along a section line 'III—III' with air jets of the air blowers acting on a sheet stack.
Figure 4:
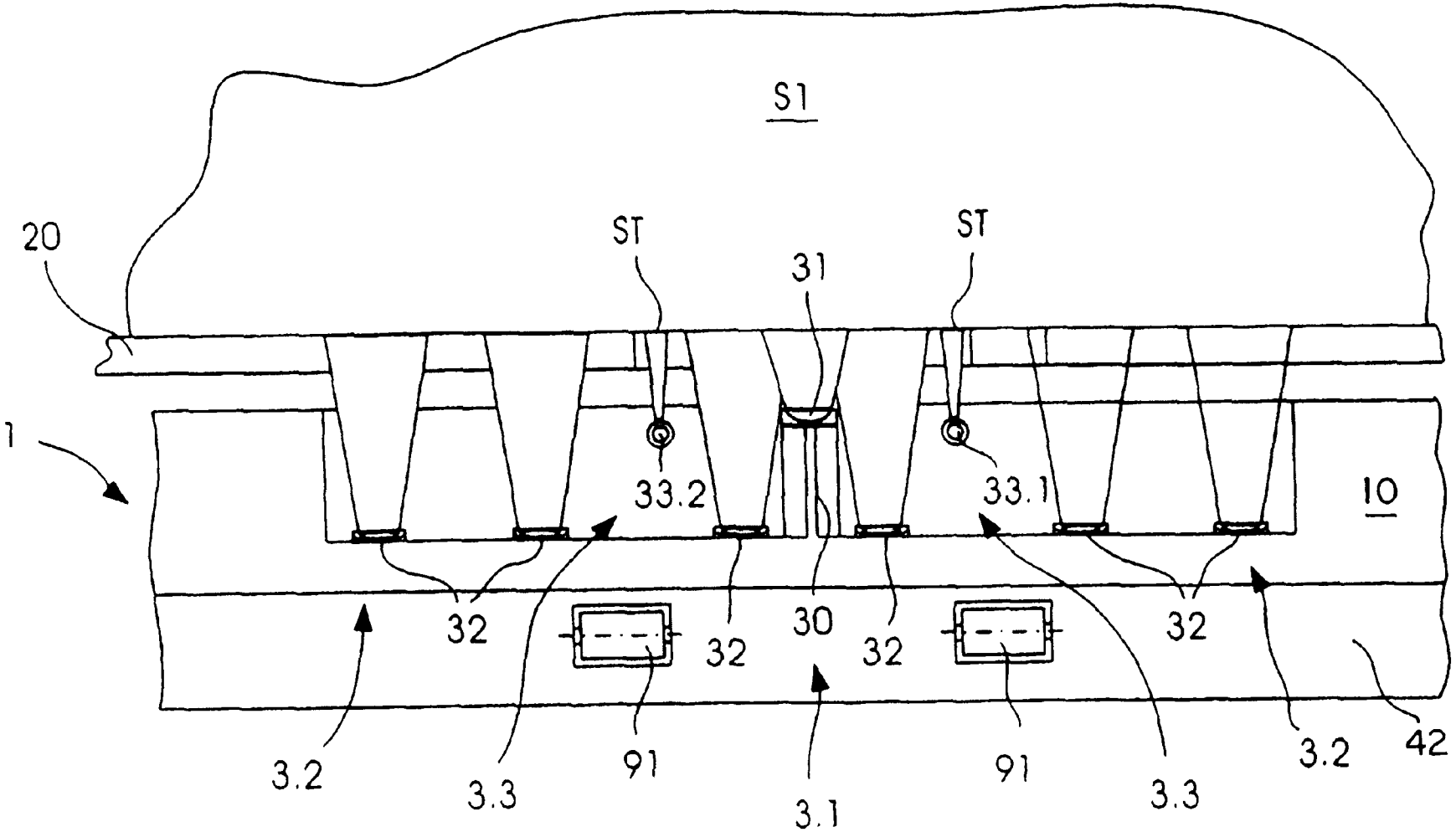
FIG. 4 shows the device according to the invention according to FIG. 2 in a top view without sheet transport unit.
Figure 5B:
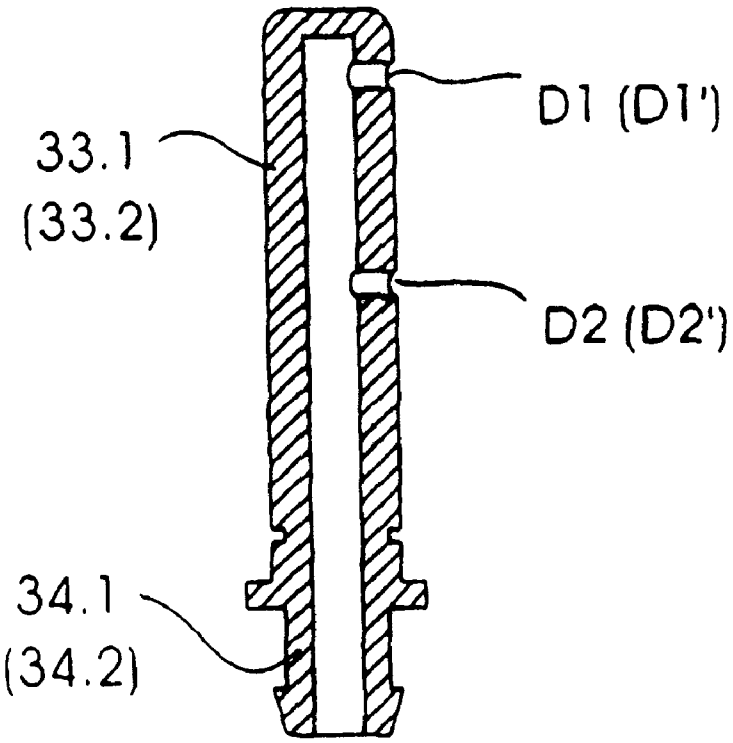
FIG. 5 shows an air blower of the device according to the invention according to FIG. 1 to FIG. 4 in a three-dimensional view (A) and as a side view (B) in the section along a section line '5B—5B'.
Figure 5A:
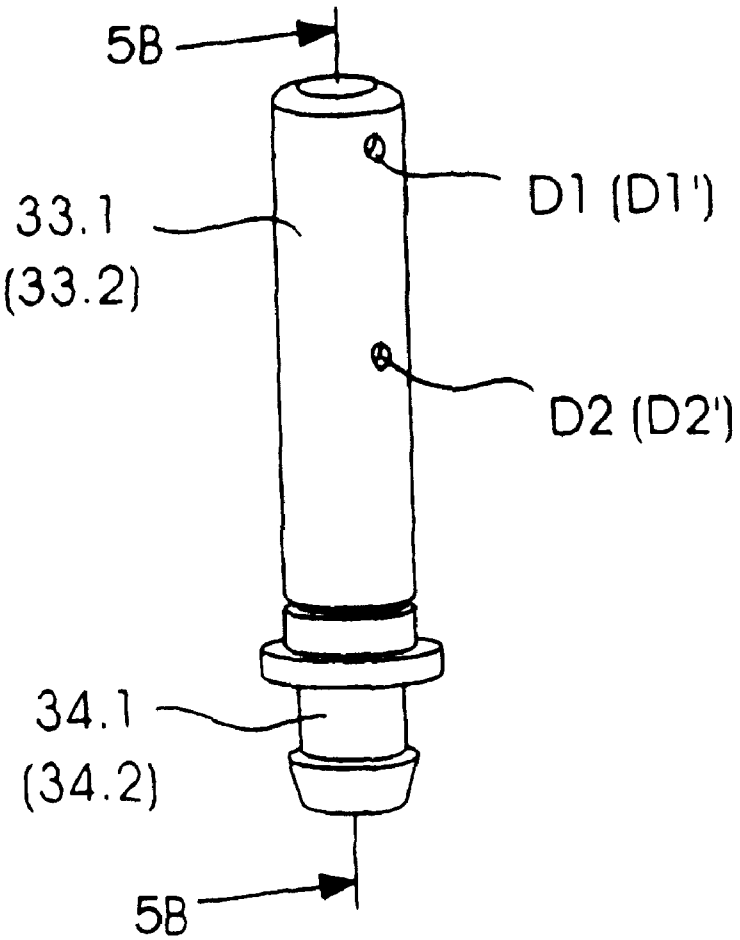

FIGS. 1 and 4 here show air blowers 3.1; 3.2, 3.3 of the device according to the invention for separating an uppermost sheet S1 from a supply stack S in the area of the sheet entrance 9 and below the sheet transport unit 4 of the device shown in FIGS. 2 and 3.

The first air blower 3.1 for spreading several sheets of an upper sheet stack area SR and second air blower 3.2 for separating the uppermost sheet S1 and holding back an adhering sheet S2, following the uppermost sheet downstream in front of the supply stack, which act against a sheet transport direction T on the upper area SR of the sheet stack S, are arranged transverse to a sheet transport path 12 in an air nozzle holder 10. Different alignments and diameters may be created by the first and second air blower 3.1, 3.2 supplied in common by an ordinary air pressure source 6, shown schematically in FIG. 3, having a low excess air pressure, air jets with low different pressures around 10–50 mbar (see FIGS. 2 and 4), on the one hand the first air blower 3.1 having an air nozzle 31 located in the area of a center line Y, Z of the stack S and the transport path 42, and on the other hand the second air blower 3.2 having several air nozzles 32 located on both sides of the center line.

Figure 2:
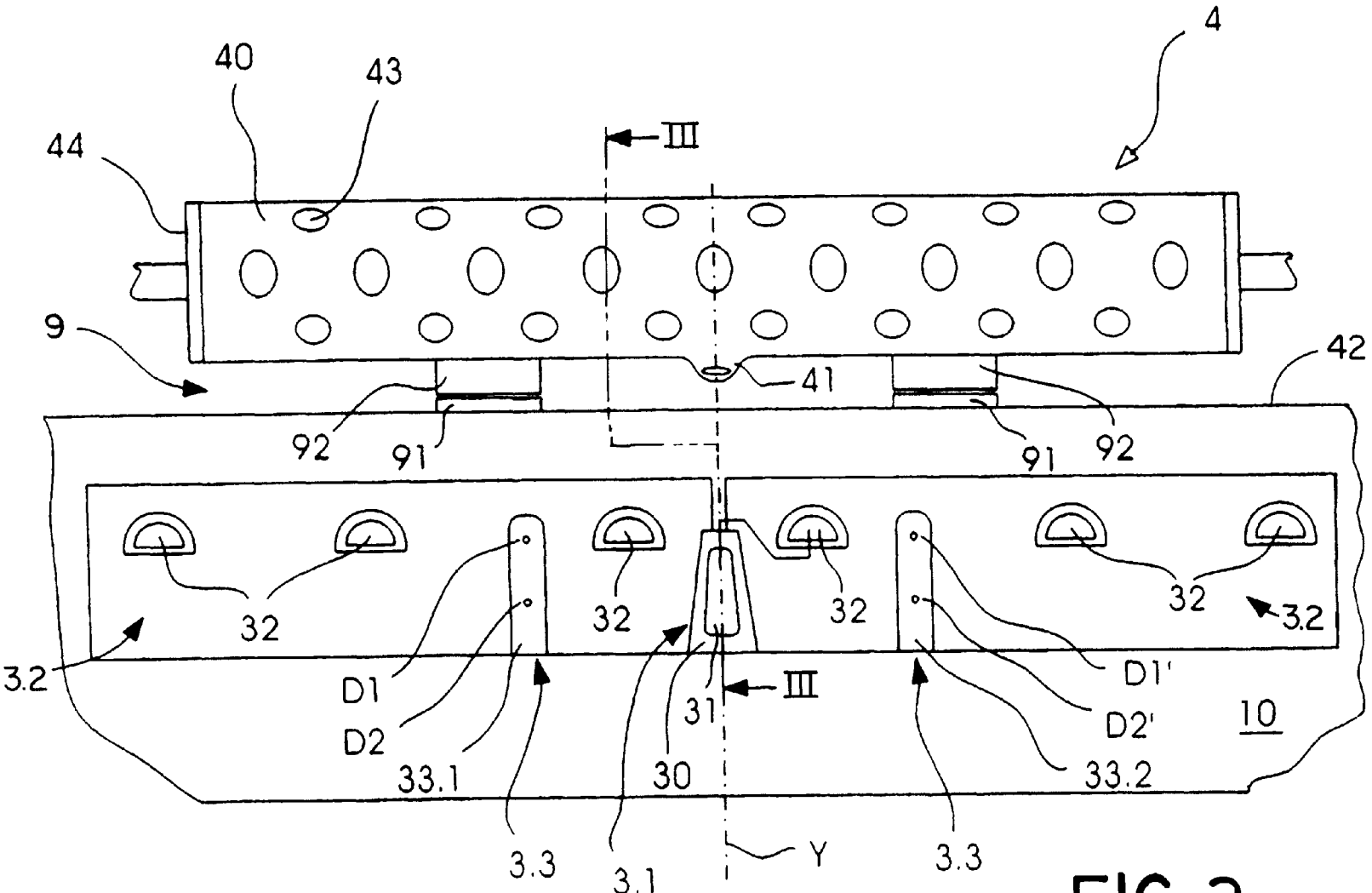
FIG. 2 shows the device according to the invention shown in FIG. 1 with air blowers in a magnified three-dimensional partial representation, as seen in the direction of sheet transport and with a sheet transport unit.

Moreover, as is shown in FIGS. 1 to 5B, an additional third air blower 3.3, having several air nozzles D1, D1', D2, D2', and supplied by an ordinary high pressure air source 7, shown schematically in FIG. 3, is located in the area of the center line Y, Z of the sheet stack S and the transport path 42 on the air nozzle holder 10, by which air jets ST with a high excess air pressure and low diameter may be generated, which on the one hand support the separation of the uppermost sheet S1 of the stack as well as holding back the adhering sheet S2 following the uppermost sheet, and on the other hand serve for supporting the spreading of the sheets in the upper area SR of the sheet stack S, which makes use of paper sheets of different kinds, thickness, and weight (e.g. 60–300 g/m$^2$) in the copy machine.

Both air pressure sources 6, 7 are, as shown in FIG. 3, coupled by control lines 80, 81, with an air control unit 8 which is connected via a control line 82 with an ordinary microprocessor unit of the device, (not shown), and may be controlled according to a control program. The first and second air blower 3.1, 3.2 are connected via an air line 60 with the low pressure air source 6 and the third, additional air blower 3.3 is connected via its connections 34.1, 34.2 (see FIGS. 5A and 5B) and air line 70 with the high pressure air source 7.

By the high pressure air source 7 and the air nozzles D1, D1', D2, D2' of the third, additional air blower 3.3 air jets ST may be generated with an excess air pressure equal to or greater than 1.0 bar, and the ratio of the first spreading and second separating air blowers 3.1, 3.2 air jets of the additional air blower 3.3 to those of the first spreading and second separating air blowers 3.1, 3.2 is equal to or greater than 20:1.

The sheet stack S in magazine 2 is, as shown in FIG. 1, located on a lifting platform 50 of an ordinary sensor-controlled lifting device 5 not shown further, and with its upper sheet stack area SR automatically capable of being positioned by the lifting device 5 to a predetermined height equal to the blowers 3.1, 3.2, 3.3. The sheet stack magazine 2 has a front stop 20 (see FIG. 3), a back stop 21, and two side stops 22 for centering and lateral guiding of the sheet stack S during its lifting motion, interruptions being located on the front stop 20 in the upper area of the sheet stack SR as passages for the air jets of the air blower 3.1, 3.2, 3.3, and the height of all stops is predetermined (see FIGS. 3 and 4).

The generally known sheet transport device 4 shown in FIGS. 2 and 3 on the one hand has conveyor belts 40, revolving in the direction of transport T and perforated with air passage holes 43, with an integrated suction device 46 made as suction holders, operating with a partial vacuum, and on the other hand has sheet bending mechanism 41 in the area of the middle axis of the sheet transport means, respectively the center line Z of the sheet transport path 42. The sheet bending mechanism 41 in this case are located axially central on the outer circumference of drive roller 44 and guide roller 45 of the sheet conveyor belt 40 as a bead projecting radially outward in the direction of the upper side of the sheet stack. The sheet transport device 4 is, as known from the prior art, spaced from the upper side of the sheet stack with the underside of its sheet bending mechanism 41, respectively its sheet conveyor belt, in the known way.

Lower and upper sheet transport rollers 91, 92 are connected downstream with the sheet transport device 4 and the air blower 3.1, 3.2, 3.3, as shown in FIGS. 1, 2, and 4, the lower transport roller 91 being mounted on the air nozzle holder 10.

The first air blower 3.1 for spreading the sheet stack S contains, as shown in FIGS. 1 to 4, an air nozzle piece 30 with an air nozzle 31 with a relatively large trapezoidal opening, located centered onto the center line Z. The second air blower 3.2 for separating an uppermost sheet S1 from the sheet stack S has air nozzles 32 with relatively large semicircular/D-shaped air nozzle openings lying on the back, which are mounted in a horizontal arrangement, aligned plane-parallel to the plane of the stack sheets and at a right angle to the sheet transport path 42, in each case three air nozzles 32 separated from one another are mounted directed in a line on both sides of the first air blower 3.1.

The air nozzles 31, 32 of the first and second air blower 3.1, 3.2, and thus their air jets, on the one hand, in a top view according to FIG. 4, are oriented parallel to the center line Z of the sheet transport path 42, respectively perpendicular to the front side of the sheet stack, and on the other hand, in a side view according to FIG. 3, are oriented at an angle of 20–36° to the horizontal plane of the stack sheets S rising to the upper area SR of the sheet stack S.

The third, additional air blower 3.3 has, as shown in FIG. 1, two nozzle elements 33.1, 33.2 with several air nozzles D1, D1', D2, D2', which are positioned on both sides of the first (spreading) air blower in a vertically overlapping arrangement, the upper air nozzles D1, D1' with their air jets are directed toward a central front edge area of the second and third sheets of the sheet stack S for the purpose of separating and holding back the adhering second sheet S2 following the uppermost stack sheet S1, and the lower air nozzles D2, D2' with their air jets for supporting the spreading and lifting of the sheets located thereunder are directed toward the central front edge area thereof Y, Z.

The upper air nozzles D1, D1' of the two nozzle elements 33.1, 33.2 here are, as shown in FIGS. 2 and 3, arranged approximately at the height of the upper edge of air nozzle openings of the air blower 3.2 for separation and above the upper edge of the air nozzle opening of the air blower 3.1 for spreading, and the two lower air nozzles D2, D2' of the two nozzle elements 33.1, 33.2 are located at approximately the level of the middle of the air nozzle opening of the air blower 3.1 for spreading.

Moreover, the two nozzle elements 33.1, 33.2 with their air nozzle openings D1, D1', D2, D2' are arranged along the direction of transport T of the sheet transport path 42 between the air nozzle openings of the spreading air blower 3.1 and the separating air blower 3.2, all three air blowers 3.1, 3.2, 3.3 being located at a predetermined distance from the front side of the sheet stack, set for optimized operation.

As shown in FIGS. 1 to 4, the air nozzles of the additional air blower 3.3, and thus their air jets ST are directed parallel to the horizontal plane of the sheets of stack S (FIG. 3) and parallel to the center line Y, Z of the stack and the sheet transport path 42. (FIG. 4)

The air nozzles D1, D1', D2, D2' of the additional third air blower 3.3 on the one hand have an opening diameter equal to or greater than 0.5 mm, and on the other hand the ratio of the air nozzles of the additional air blower to those of the spreading 3.1 and separating air blower is equal to or greater than 1:20 (see FIGS. 3 to 5B).

In the device 1 according to the invention the pressure of the air jets ST of the additional, third air blower 3.3 is essentially constant during an operating cycle controlled by the control unit 8. The air jets ST of the additional air blower 3.3 here act on the sheets of the upper sheet stack area SR simultaneously with air jets 31, 32 of the spreading air blower 3.1 and separating air blower 3.2, also having a constant air pressure.

In an alternative embodiment of device 1, the air pressure of the air jets ST of the additional air blower 3.3 may be made to pulsate during the operating cycle.

The device according to the invention operates as follows:

Starting from a sheet supply stack S in magazine 2, the upper edge of the stack of which has been brought to a predetermined height, the removal position, by means of the lifting device 5, the copier is switched to an operating mode for an operator to carry out a coping order.

In this case first the compressed air sources 6, 7 to the two low pressure air blower 3.1, 3.2 and to the high pressure air blower 3.3 is switched on by the air control unit 8, and air jets, which strike the front, upper area SR of the sheet stack S with constant low and high excess air pressure (see FIG. 3), are produced.

Then the sheets are raised somewhat and spread apart in the upper sheet stack area SR in the vertical direction Y, these spread-apart sheets being supported on the rear stop 21 of the magazine 2 (see FIG. 1). The upper two sheets of the sheet stack S1 and S2 in this case are raised or spread apart somewhat more in comparison with the following ones (see FIG. 3).

Then the sheet transport unit 4 is switched on by the microprocessor unit of the device or by the control program thereof, that is, an ordinary vacuum generator of the sheet suction device 46 and an ordinary drive unit, not shown, on the drive roller 44 of the conveyor belt 40 are switched on.

Now the uppermost raised sheet S1, separated by the device 1, is sucked from the sheet stack S on the underside of the conveyor belt by the partial vacuum arising on the underside of the perforated conveyor belt 40 of the transport unit 4 and transported by the conveyor belt 40, revolving in the direction of transport, in the direction of the sheet entrance area 9, or to a first processing station, not shown, (e.g. an image transfer station) of the device, while the second uppermost sheet S2 and following sheets are held back by the air jets of the second and third air blowers 3.2 and 3.3 (see FIGS. 1 and 3).

As soon as the first sheet S1 has arrived with its front edge between the also driven lower and upper sheet transport rollers 91, 92, the sheet suction device 46, and the conveyor belt drive unit of the sheet transport unit 4 is switched off sensor-controlled (sensor of known type in the area of the transport rollers, not shown), and the further transport of the first sheet S1 into the interior of the device is taken over by the transport rollers 91, 92 in the entrance area 9 of the device.

After the first sheet S1 has passed the transport rollers 91, 92, the sheet suction device 46 and the conveyor belt drive unit of the sheet transport unit 4 is switched on again sensor controlled, and the now uppermost, second raised sheet S2 of the sheet stack S is sucked to the underside of the conveyor belt and transported in the direction to the interior of the device.

This process is repeated now until a copy order entered by the operator via a control panel of the device is completed, whereby the sheet stack S is raised sensor-controlled with its upper edge into the predetermined same sheet removal position or height by means of the lifting platform 50 according to the sheet removal.

Parts List

D1 upper air nozzle of first nozzle element (additional/third air blower)
D1' upper air nozzle of second nozzle element (additional/third air blower)
D2 lower air nozzle of first nozzle element (additional/third air blower)
D2' lower air nozzle of second nozzle element (additional/third air blower)
S sheet supply stack
S1 uppermost sheet of supply stack
S2 second sheet of supply stack
SR upper sheet stack area
ST air jets of the additional/third air blower
T direction of transport of the sheets from the stack
Y center line of supply stack
1. device for separating an uppermost sheet from the supply stack
2. magazine for supply stack (sheet stack)
3.1 first air blower/air blowing unit for sheet spreading
3.2 second air blower/air blowing unit for sheet separation
3.3 third/additional air blower/air blowing unit for sheet spreading/separation
4. sheet transport unit
5. lifting device
6. compressed air source (low pressure)
7. high pressure air source

8. control unit
9. sheet entrance area of sheet processing device
10. air nozzle holder
20. front stop for sheet stack (magazine)
21. rear stop for sheet stack
30. nozzle head of the first air blower
31. air nozzle of the first air blower for spreading the upper stack sheets
32. air nozzles of the second air blower/for separating the uppermost sheet from the stack
33.1 first nozzle element of the third/additional air blower
33.2 second nozzle element of the third/additional air blower
34.1 pipe connections of the first nozzle element of the third air blower
34.2 pipe connections of the second nozzle element of the third air blower
40 sheet conveyor belt (sheet transport unit)
41. sheet bending means (sheet transport unit)
42. sheet transport path
43. air passage holes on the sheet conveyor belt
44. drive roller for sheet conveyor belt
45. guide roller for sheet conveyor belt
46. suction tank
50. lifting platform for sheet stack in the magazine (lifting device)
60. air line for first and second air blowers from compressed air source
70. air line for third air blower from high pressure air source
80. control line to the compressed air source
81. control line to the high pressure air source
82. control line to control unit of CPU
91. lower sheet transport roller(s) in the sheet entrance area
92. upper sheet transport rollers in the sheet entrance area

What is claimed is:

1. Device (1) for separating an uppermost sheet (S1) from a supply stack (S) in the area of a sheet transport unit (4) operating with a partial vacuum and having a sheet bending mechanism (41), for the purpose of grasping the separated uppermost sheet and feeding it to a processing station in a sheet processing device, said device (1) comprising:

a first air blower (3.1) for spreading out several sheets of an upper sheet stack area (SR); a second air blower (3.2) for separating the uppermost sheet (S1) and holding back an adhering sheet (S), following the uppermost sheet (S1) said first and second air blowers (3.1, 3.2) being located downstream in front of the supply stack and transverse to a sheet transport path (42) and act against a sheet transport direction (T), in said sheet transport path, and the upper area of the sheet stack, which may be positioned at the same predetermined height by a lifting device (5), and wherein air jets with different pressures, directions, and diameters may be generated by said first and second air blowers (3.1; 3.2) supplied from an air pressure source (6) with at least one air nozzle (31) located in the area of a center line (Y, Z) of the stack (2) and the transport path (42), and with several inner air nozzles (32) located on both sides of the center line said first air blower (3.1) being outside of the inner air nozzles (32); and a third air blower (3.3), having two nozzle elements (33.1, 33.2), respectively on either side of the first air blower (3.1), in the area of the center line (Y, Z) of the stack (S) and the transport path (42), supplied from a high pressure air source (7), each of said nozzle elements (33.1, 33.2) having a vertically overlapping arrangement, with upper air nozzles (D1, D1') directed toward a middle front edge area of the second and third sheets of the stack (S) for the purpose of separating and holding back the adhering second sheet (S2) following the uppermost stack sheet (S1), and lower air nozzles (D2, D2') directed toward the middle front edge area of the sheets located thereunder in order to spread them apart and lift them, wherein said two nozzle elements (33.1, 33.2) provide air jets (ST) generated with a high excess air pressure and small diameter, which on the one hand support the separation of the uppermost sheet (S1) from the stack as well as hold back the adhering sheet (S2) following the uppermost sheet, and on the other hand are used to spread apart the sheets in the upper area of the sheet stack.

2. Device according to claim 1, characterized in that air jets (ST) with an excess air pressure equal to or greater than 1.0 bar may be generated by the high pressure air source (7) and the air nozzles (D1, D1', D2, D2') of the additional air blower (3.3), and that the pressure ratio of the air jets of the additional air blower (3.3) to those of the spreading and separating air blower (3,1,3,2) is equal to or greater than 20:1.

3. Device according to claim 1, characterized in that the upper air nozzles (D1, D1') of the two nozzle elements (33.1, 33.2) are located at approximately the height of the upper edge of the air nozzle openings (32) of the air blowers (3.2) for separating and above the upper edge of the air nozzle opening (31) of the air blowers (3.1) for spreading, and that the two lower air nozzles (D2, D2') of the two nozzle elements (33.1, 33.2) are located at approximately the height of the middle of the nozzle opening (31) of the air blower (3.1) for spreading.

4. Device according to claim 3, characterized in that the air nozzles of the additional air blower (3.3) and thus the air jets (87) thereof are directed parallel to the horizontal plane of the sheets of the stack (S) and parallel to the center line (Y, Z) of the stack and the sheet transport path, and that the air jests (31, 32) of the spreading (3.1) and separating air blowers (3.2) and this the air jets are directed at an angle rising from the horizontal plane of the stack sheets to the upper area (SR) of the stack.

5. Device according to claim 1, characterized in that the two nozzle elements (33.1, 33.2) are located with their air nozzle openings (D1, D1', D2, D2') along the direction of transport (1) of the sheet transport path (42) between the air nozzle openings of the spreading air blower (3.1) and the separating air blower (3.2).

6. Device according to claim 1, characterized in that the air nozzles (D1, D1', D2, D2') of the additional air blower (3.3) have an opening diameter equal to or smaller that 0.5 mm, and that the ratio of the opening diameter of the air nozzles of the additional air blowers to those of the spreading (3.1) and separating air blowers (3.2) is equal to or greater than 1:20.

7. Device according to claim 1, characterized in that the air pressure of the air jet (ST) of the additional air blower (3.30) is essentially constant during an operating cycle, and that the air jets (ST) of the additional air blower (3.30) act simultaneously on the sheets of the upper sheet stack area (SR) with the air jets (31;32) of the spreading air blowers (3.1) and separating air blowers (3.2), having a constant air pressure.

8. Device according to claim 7, characterized in that the air pressure of the air jets (ST) of the additional air blower (3.3) is pulsating during an operating cycle.

* * * * *